US005697873A

United States Patent [19]

Van Straaten

[11] Patent Number: 5,697,873

[45] Date of Patent: Dec. 16, 1997

[54] EXERCISING DEVICE

[76] Inventor: Willem Johannes Van Straaten, 49 Trafalgar Street, Sandhurst, Johannesburg, South Africa

[21] Appl. No.: 572,569

[22] Filed: Dec. 14, 1995

[30] Foreign Application Priority Data

Jul. 14, 1995 [ZA] South Africa ..... 95/5876

[51] Int. Cl.[6] ..... A63B 21/02

[52] U.S. Cl. ..... 482/126; 482/122; 482/124

[58] Field of Search ..... 482/121, 122, 482/124, 126

[56] References Cited

U.S. PATENT DOCUMENTS

| | | | |
|---|---|---|---|
| 399,699 | 3/1889 | Sachs | 482/126 |
| 1,956,498 | 4/1934 | Duke | 482/126 |
| 3,343,837 | 9/1967 | Grzybowski | 482/126 |
| 3,544,106 | 12/1970 | Barrett | 482/126 |
| 3,761,083 | 9/1973 | Buchner | 482/126 |
| 5,232,425 | 8/1993 | Miller et al. | 482/126 |

*Primary Examiner*—Lynne A. Reichard

*Attorney, Agent, or Firm*—Birch, Stewart, Kolasch & Birch, LLP

[57] ABSTRACT

An exercise device comprises an elongate strut on which a pair of limb engaging members are located. At least one of the limb engaging members is slidable along the length of the strut towards and away from the other member. A resistive force means such as one or more elastomeric bands links the movable limb engaging member to a reaction point on the strut or the other limb engaging member. The arrangement is such that movement of the movable limb engaging member along the strut in at least one direction requires work to be done against the action of the resistive force means. Preferably both limb engaging members are movable along the length of the strut towards and away from each other. The strut may be formed in more than one section with the different ends of the sections engageable with each other to provide for different modes of operation of the device.

8 Claims, 9 Drawing Sheets

EXERCISING DEVICE

BACKGROUND TO THE INVENTION

THIS invention relates to an exercising device of the type which a user can use in his or her own home and which is easily transportable and stowed.

Exercising devices are well known and a great number of devices have been developed for exercising many of the body's muscles. Many devices are designed specifically to exercise one or other muscle or groups of muscles and a user will often select a particular device so as to exercise the group of muscles which the user requires to be worked.

One such group of muscles are to be found in the thigh, hip and buttock region and devices have been developed for specifically exercising those groups of muscles. Many prior art devices or machines for exercising these groups of muscles are, however, complex and costly and inappropriate for use in a domestic location where space required for cumbersome machines is not generally readily available.

SUMMARY OF THE INVENTION

According to the invention there is provided an exercise device comprising:

an elongate strut;

a pair of limb engaging members located on the strut at least one of which is movable along the length of the strut towards and away from the other member; and resistive force means linking the movable limb engageable member to a reaction point on either the strut or the other limb engaging member;

the arrangement being such that movement of the movable limb engaging member along the strut in at least one direction requires work to be done against the action of the resistive force means.

In a preferred arrangement of the invention both of the limb engaging members are movable along the length of the struts towards and away from each other. There may be more than one reaction point and specifically where both limb engaging members are movable, there may be reaction points on both ends of the strut. The resistive force means may comprise one or more elastomeric bands and preferably the device has a plurality of elastomeric bands which can be utilised in selected numbers to vary the resistive force provided by the bands.

The strut may comprise a plurality of sections which are separable from each other. Optionally the different sections have first and second ends with the first end of the or each respective section being connectable to the second end of the or each other section. The first and second ends may be male and female type connections. At least one end of each section may include a releasable catch mechanism for releasably locking the first and second ends together.

Each limb engaging member preferably comprises at least one curved arm which is adapted to locate around at least part of the thigh of a user. Optionally each limb engaging member comprises a pair of curved arms which are spaced apart to define an inverted U-shaped space therebetween which space will be adapted to receive the thigh of a user therein. At least one of the limb engaging members may be reversibly mounted on the strut so as to be selectably mountable on the strut to project either in the same side as the strut as the other limb engaging member or to the opposite side thereof.

The device may furthermore include a T-shaped member comprising a leg and a transverse cross-piece located on one end of the leg, the opposite end of the leg terminating in a pair of connection points adapted to have the strut sections connected thereto. Preferably the connection points comprise a male connection point and a female connection point.

Various embodiments of the invention are described in detail in the following passages of the specification which refer to the accompanying drawings. The drawings, however, are merely illustrative of how the invention might be put into effect, so that the specific form and arrangement of the various features shown is not to be understood as limiting on the invention.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

Figure 1:
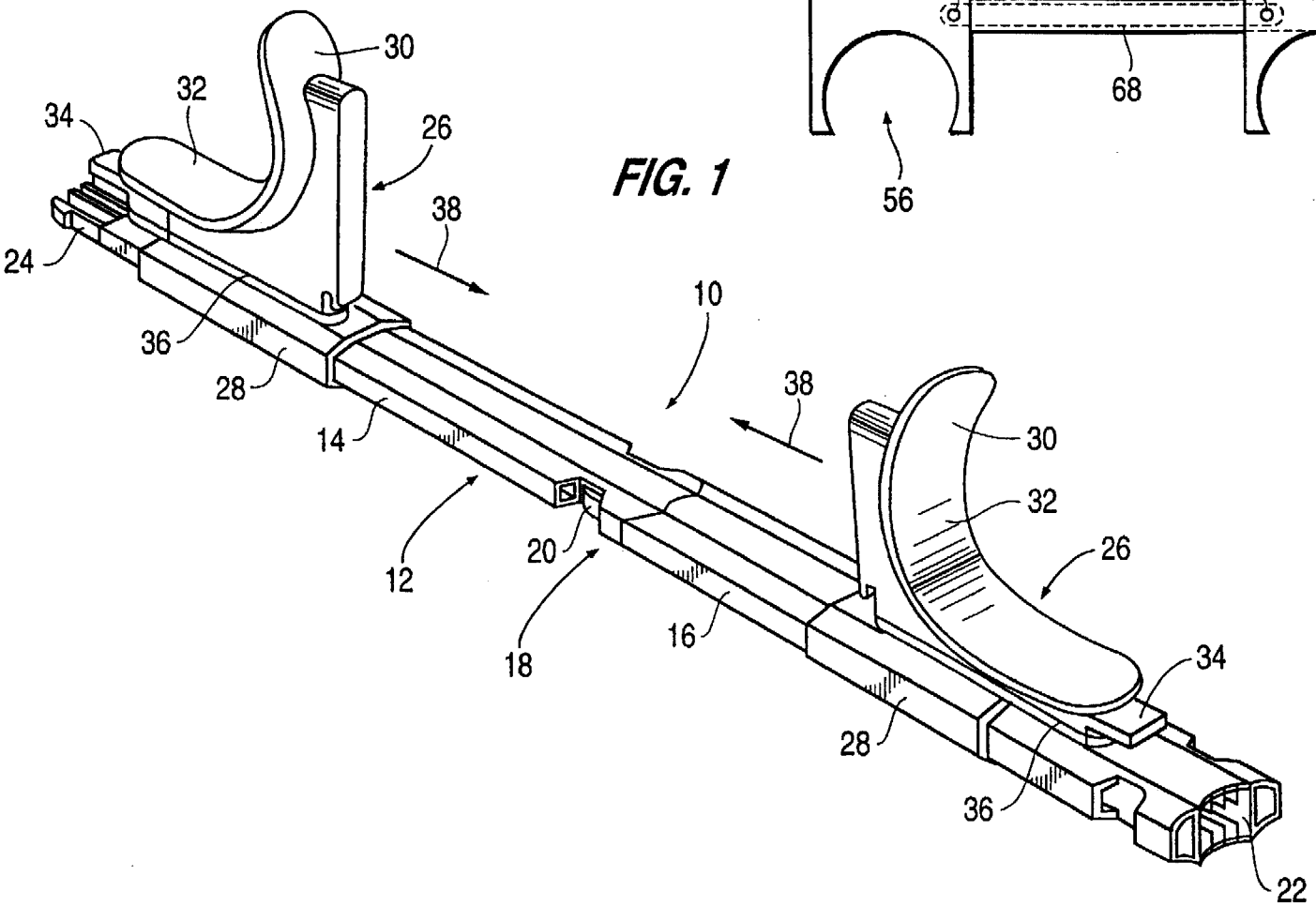
FIG. 1 shows a perspective view of one embodiment of the device.

As shown in FIG. 1, an exercising device 10 comprises an elongate strut 12 which is formed in two sections numbered 14 and 16. The two sections are connected together at joint 18, the joint 18 being separable by pressing together a pair of buttons 20. The strut is separable so as to allow for more compact packaging and stowing but also to change the mode of operation as will be described hereinbelow in more detail with reference to FIG. 2. The strut 12 has a socket 22 formed on one end thereof and a plug 24 formed in the other end thereof and the joint 18 is of similarly configured plug and socket (or male and female) arrangement.

A pair of leg engaging members 26 are slidably mounted on the strut 12. The leg limb engaging members 26 each comprise a sleeve 28 which is a smooth sliding fit on the strut 12, and an arm 30 which is of rounded form but extends generally perpendicularly to the axis of the strut 12. Each arm 30 has a curved inner surface 32 which is adapted to engage the leg of a user for hip and thigh muscle exercises.

A pair of stop formations 34 are fixed to the strut as shown. These stop formations 34 are adapted to have an elastomeric bands 36 passed therearound. The elastomeric bands 36 act to bias the two leg engaging members 26 outwardly, that is, away from each other. Clearly, by moving the leg engaging members 26 towards each other, that is in the direction of arrows 38 work will need to be done to overcome the bias provided by the elastomeric bands 36.

Figure 6:
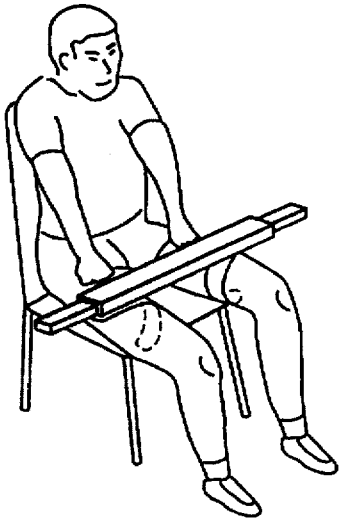
FIG. 6 depicts a perspective view of a user using a typical device of the invention.

It is envisaged that the device will be used in the orientation depicted in FIG. 6 of the drawings, that is, with the leg engaging members 26 facing downwardly. In the mode of operation depicted in FIG. 1 of the drawings the arms 30 will be located inside of the user's thighs and the user will then exercise by moving his or her thighs together thereby moving the leg engaging members 26 towards each other, against the action of the elastomeric bands 36. This exercise will then be repeated by moving the legs towards and away from each other and since the major work being done will be in moving the legs towards each other, the muscle groups on the inside of the thighs will be worked.

Figure 2A:
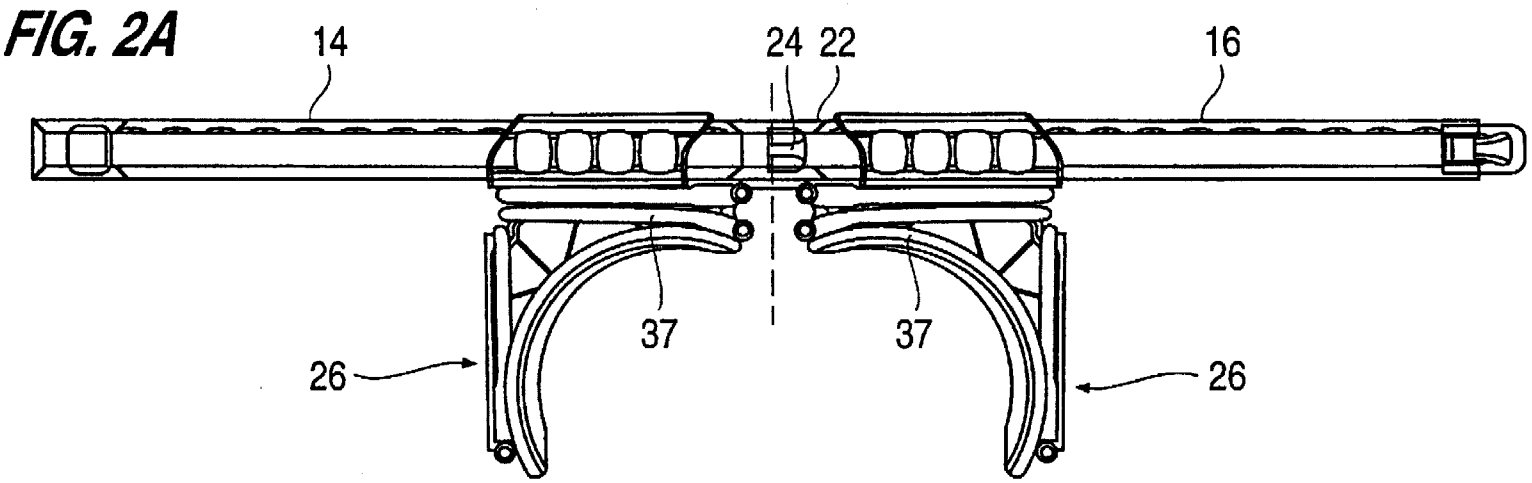
FIGS. 2A to 2E show side views of the device depicted in FIG. 1 in alternative modes of operation.
Figure 2B:
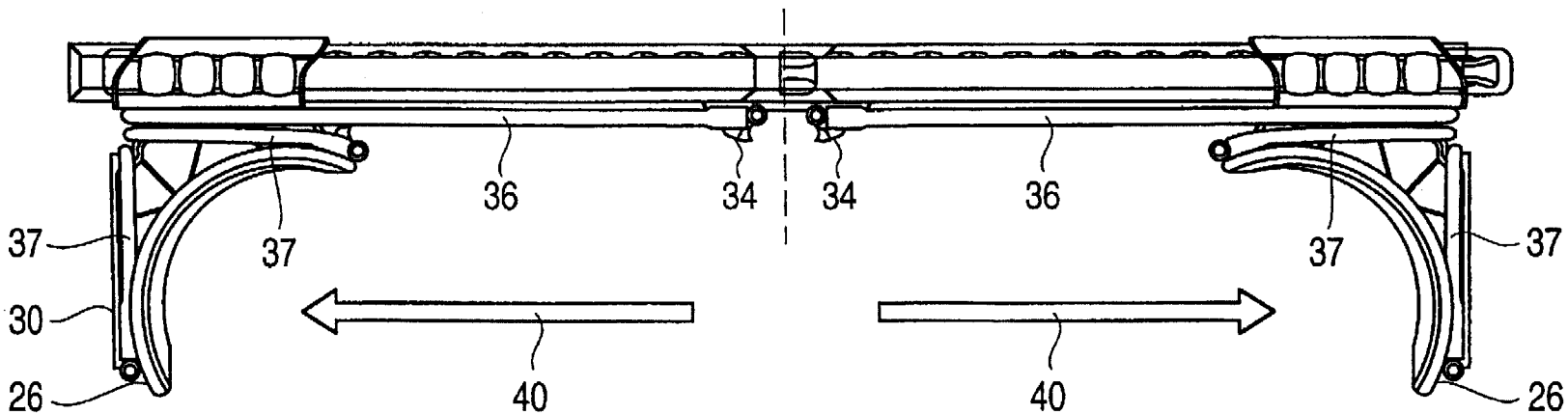

The strut sections 14, 16 can be separated from each other by disconnecting the strut at the joint 18 and then connecting plug 24 into socket 22 as depicted in FIG. 2A and 2B of the drawings. In this configuration the stop formations 34 will be located adjacent to each other at the centre of the strut and the leg engaging members 26 will be biased towards each other by the elastomeric bands 36. To exercise, the arms 30 will be placed on the outside of the user's legs and the user will then expend work in the direction of arrows 40 in moving his or her legs apart against the action of the elastomeric bands 36.

Clearly, the spring force exerted by the bands 36 will then dictate the work required to move the leg engaging members 26 towards or away from each other, as the case may be. It is envisaged that the force will be varied by increasing or decreasing the number of bands and therefore the force required to be exerted by the user can be modified for particular exercises or for particular users. Spare bands are depicted at numeral 37.

Figure 2C:
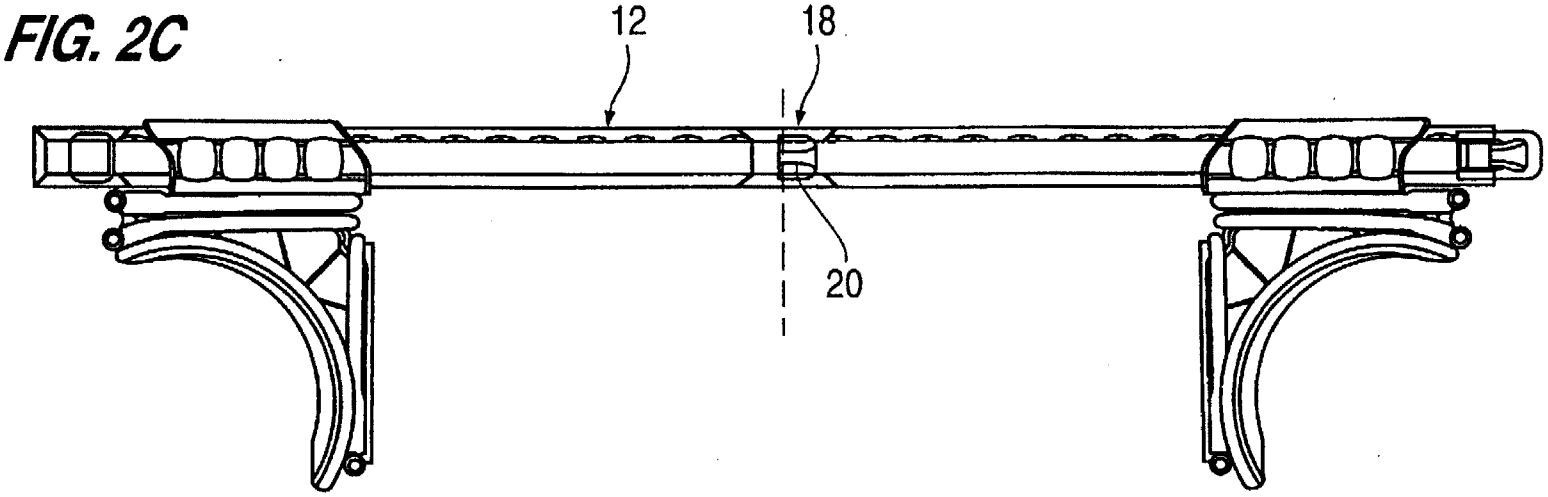
Figure 2D:
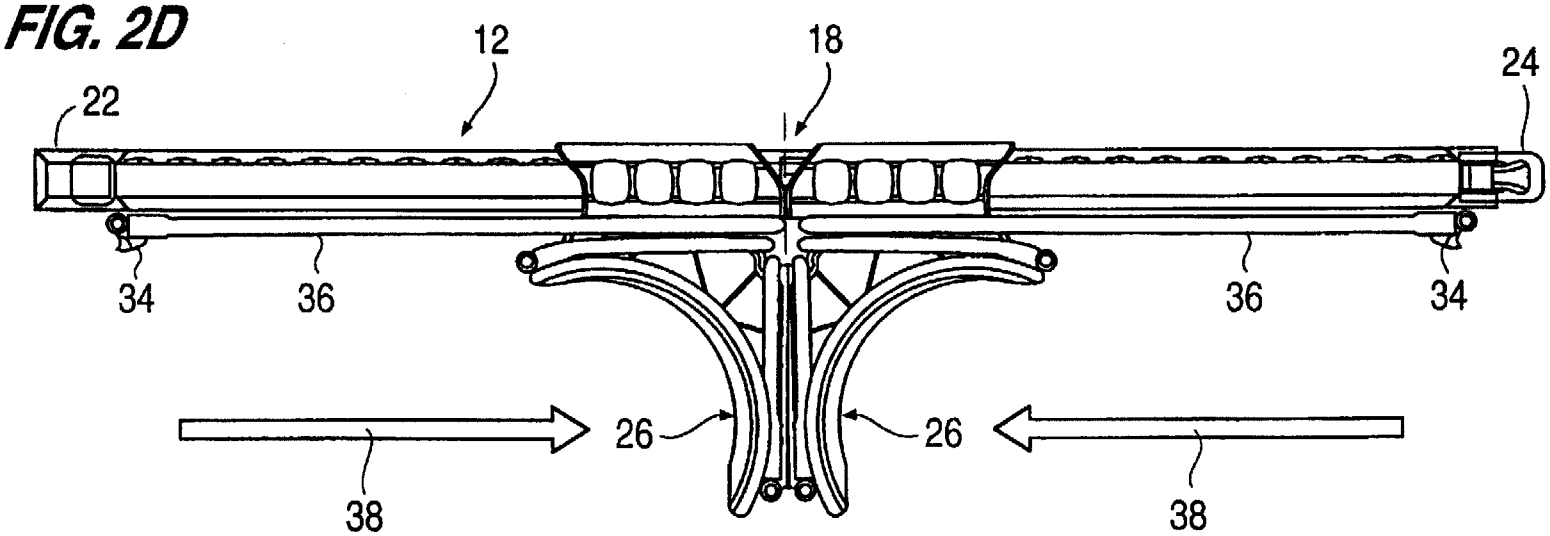
Figure 2E:
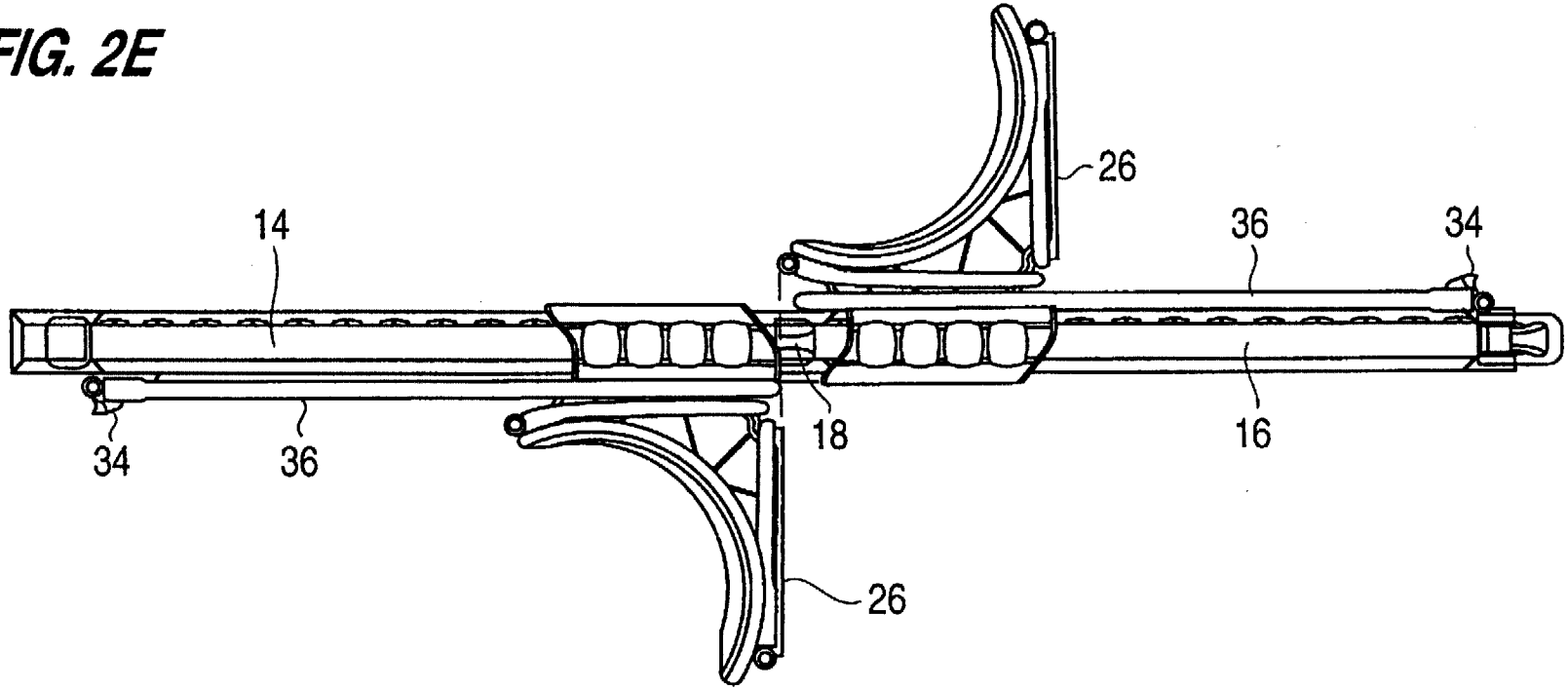

The mode of operation depicted in FIGS. 2C and 2D of the drawings are the same as shown in FIG. 1. As shown, the reaction points 34 are located towards the outside of the strut by movement of the leg engaging members 26 towards each other in the direction of arrows 38 work is done against the bands 36.

It should be noted that it is not essential that the leg engaging members 26 extend to the same side of the strut 12. For example, one of the strut sections 14 or 16 may be rotated about its longitudinal axis through 180° and then the two strut sections can be reconnected together so that one of the leg engaging members 26 extends above the strut and the other leg extending member 26 below the strut. This mode of operation allows a user to place one leg engaging member on, for example, his or her thigh and the other leg engaging member on his or her arm and perform leg/arm exercises.

Figure 3:
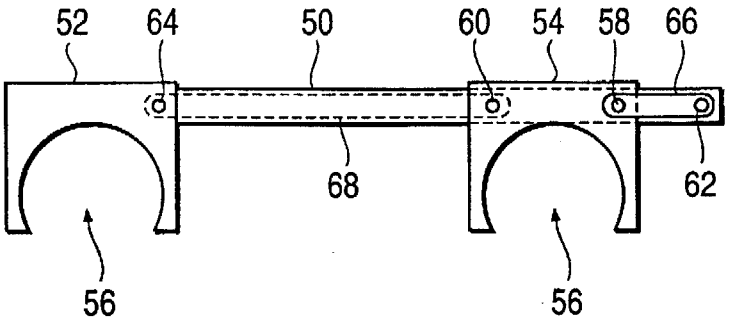
FIG. 3 depicts a side view of a second embodiment of the device.

FIG. 3 depicts somewhat diagrammatically a simple version of the device. This device comprises an elongate strut 50 which has a first leg engaging member 52 fixed to one end of the strut and a second leg engaging member 54 slidable along the length of the strut. Each of the leg engaging members 52 and 54 has a generally inverted U-shaped recess 56 formed therein into which a user's thigh may be positioned in order to exercise. The second leg engaging member 54 has two lugs thereon, numbered 58 and 60 in the drawings. The strut 50 has a pair of lugs thereon numbered 62 and 64. An elastomeric band 66 can then be selectively fitted round either struts 58 and 62 as shown in the drawings all around lugs 60 and 64 as shown by dotted lines 68 in the drawings. Clearly, depending on the location of the elastomeric bands 66 the movable leg engaging member 54 can either be biased towards the fixed leg engaging member 52, or away therefrom, depending on the user's exercise requirements. Once again, the spring force can be adjusted by increasing or decreasing the number of elastomeric bands 66 located on the device.

Figure 4A:
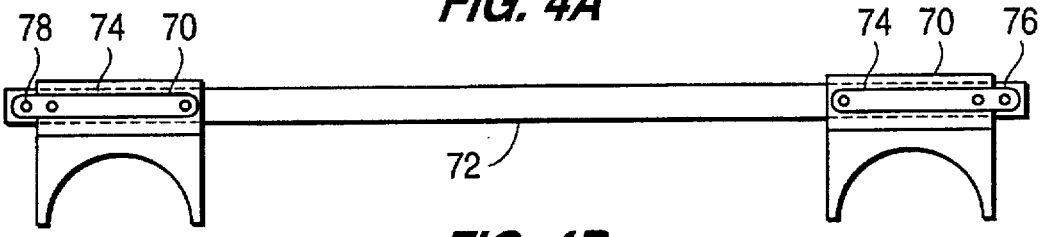
FIGS. 4A & 4B depict a third embodiment of the device in different modes of operation.
Figure 4B:
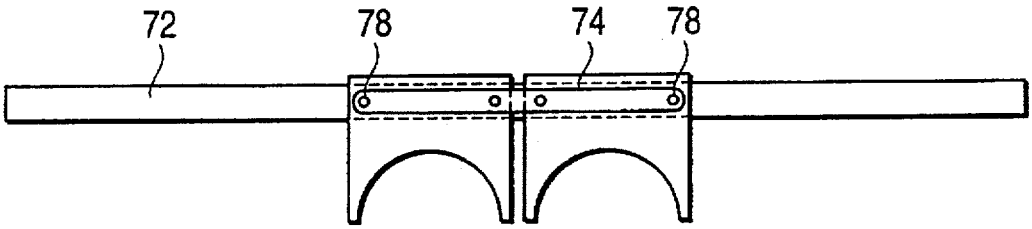

The device shown in FIGS. 4A and 4B is similar to that shown in FIG. 3 except that both leg engaging members 70 are movable relative to the strut 72. Each of the leg engaging members has its own elastomeric band 74 and the band 74 can either be located around reaction points 76 located on either end of the struts 72, as shown in FIG. 4A, or can be connected to the lugs 78 as shown in FIG. **4*b***. Thus, the leg engaging members can either be biased towards each other or away from each other depending on the user's requirements.

Figure 5A:
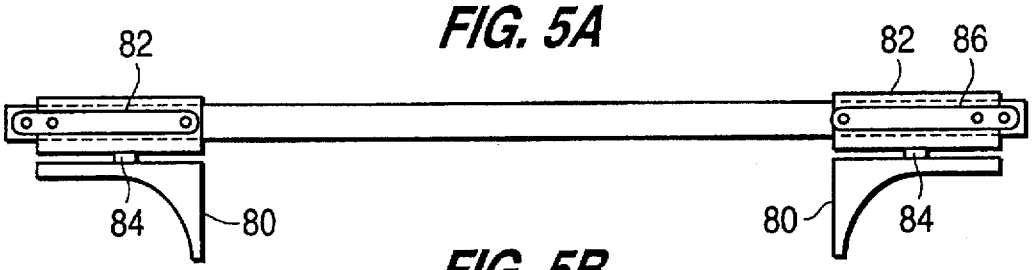
FIGS. 5A & 5B depict a side view of a fourth embodiment of the device in different modes of operation.
Figure 5B:
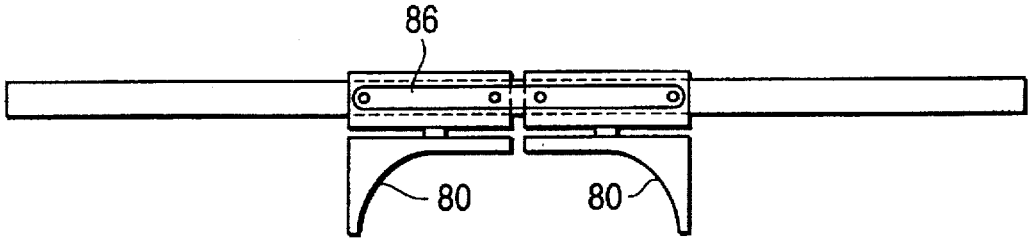

The device shown in FIGS. 5A and 5B is similar to that shown in FIGS. 4A and 4B except that, in place of having U-shaped leg engaging members the leg engaging members 80 are L-shaped and are connected to slides 82 via lockable swivels 84 to permit the leg engaging members 80 to be used in either mode of operation in the manners depicted in FIGS. 5A and 5B. It will be noted that the elastomeric bands 86 are utilised in the same manner as that depicted in FIGS. 4A and 4B.

An appropriate manner of using the device is depicted in FIG. 6 of the drawings. The strut is shown located above the sides of the user and the leg engaging members extend downwardly from the strut to straddle on either side of the thighs of the user. The user it will be noted is in a sitting position. Clearly by moving his or her legs apart the user's thighs will be exercised in the manner described above.

The device need not be used in the manner depicted in FIG. 6 and indeed it is envisaged that many other exercises may be performed with the device. Where the device is of the type depicted in FIGS. 1 and 2 of the drawings the leg or limb engaging members may be positioned so that one member extends above the strut and the other member extends below the strut. This will allow leg/arm exercises to be performed, for example.

Figure 7B:
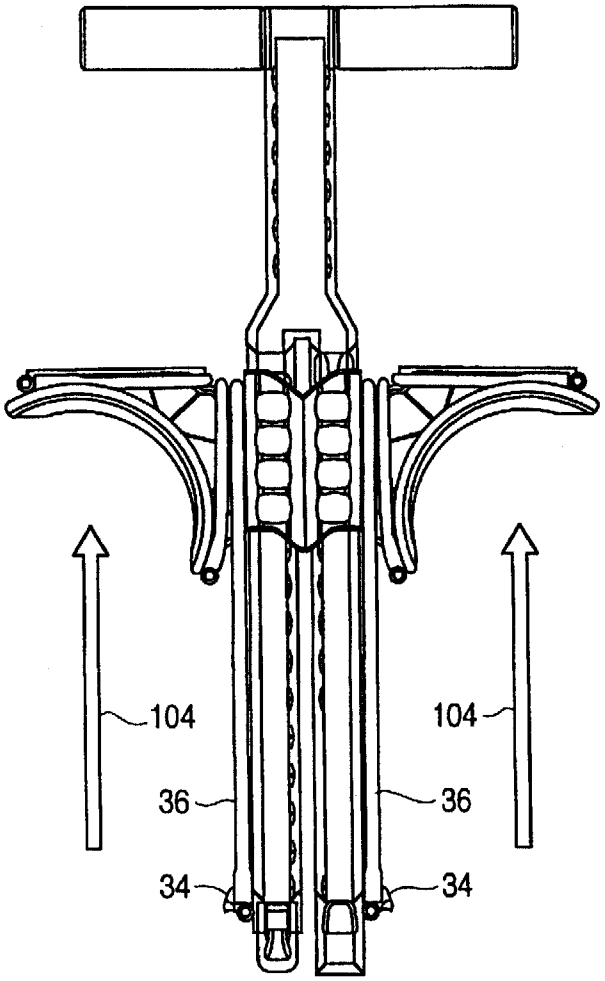
FIGS. 7A & 7B depict side views of the embodiment shown in FIG. 1 in alternative mode of operation.
Figure 7A:
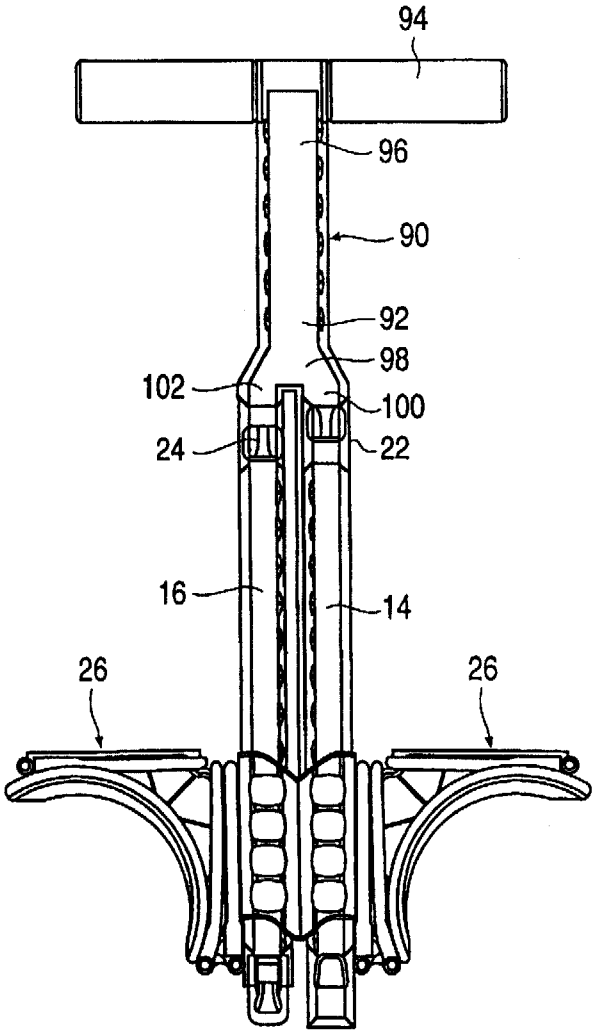

Turning now to FIGS. 7A and 7B of the drawings, a further component for the device is shown. This component comprises a T-shaped member 90 having a leg 92 and a transverse handle 94 connected to one end 96 of the leg. The other end 98 of the member 90 branches to form a pair of connection points 100 and 102. The connection point 100 is a plug or male connection point which is adapted to have a socket 22 of a strut section 14 connected thereto. The connection point 102 is a socket or female connection point which is arranged to have the plug or male connection point 24 of strut section 16 connected thereto. Thus, the strut sections 14 and 16 extend side-by-side as shown with the leg engaging members 26 slidable thereon.

Figure 8:
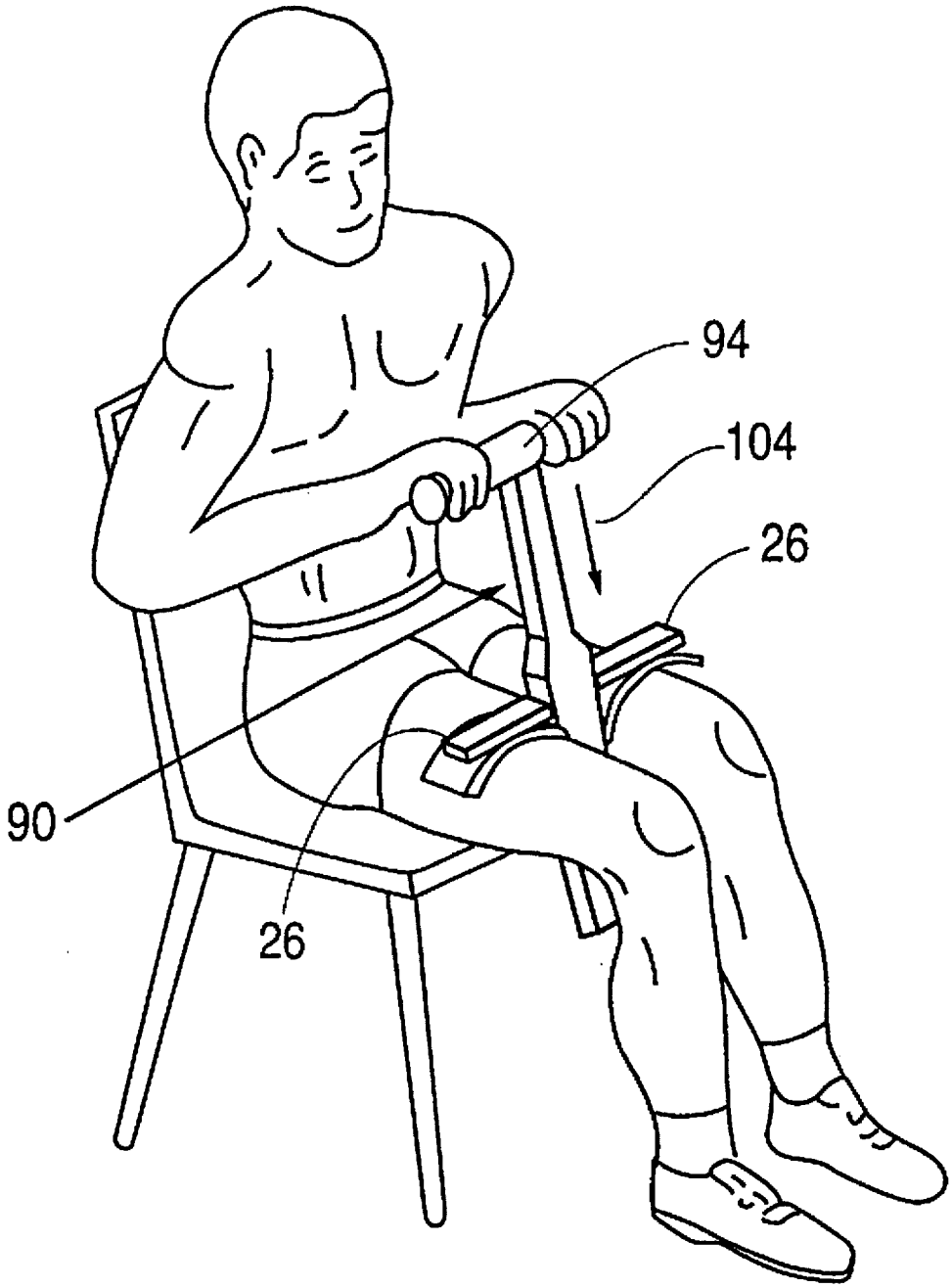
FIG. 8 depicts a perspective view of a user using the device shown in FIGS. 7A and 7B.

In use the members 26 will be movable towards the handle 94 in the direction of arrows 104 in order to work against the biasing effect of the bands 36. The manner of operation of the device as depicted in FIG. 8 of the drawings.

Figure 9:
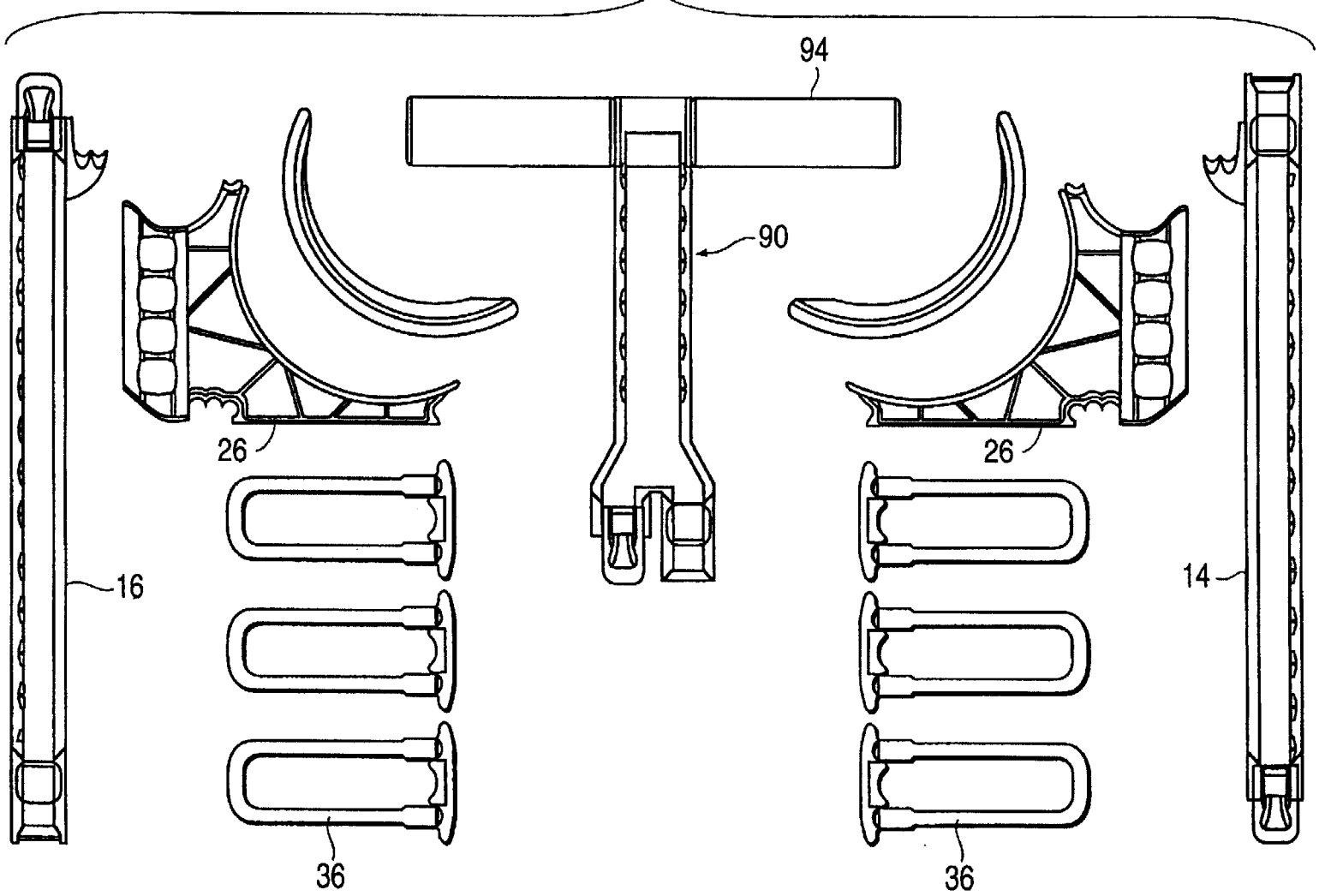
FIG. 9 depicts side views of the device shown in FIG. 1 in disassembled form.
Figure 10:
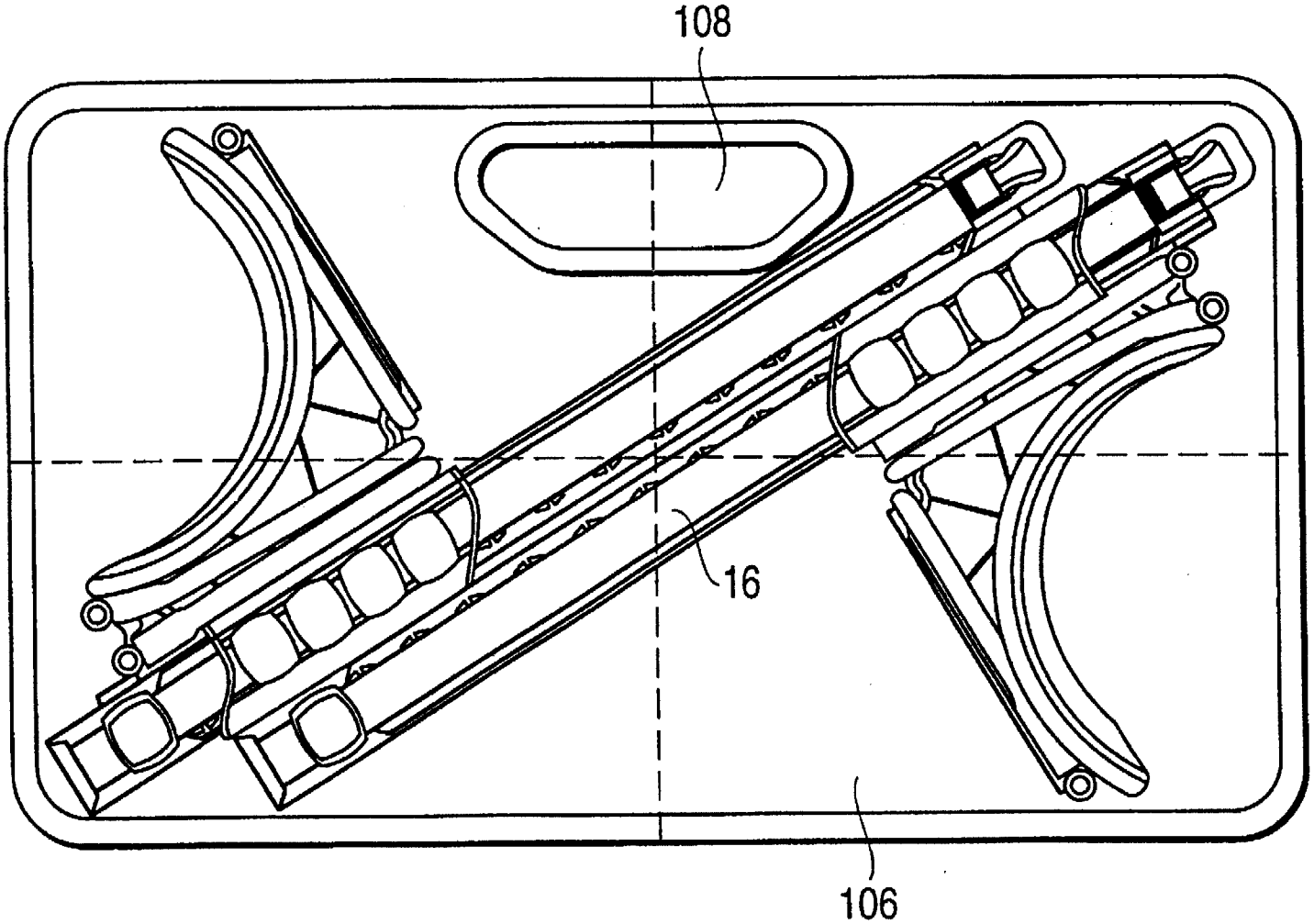
FIG. 10 depicts a typical packaging arrangement for the device shown in FIG. 1.

The various components which make up the device in its totality are depicted in FIG. 9 of the drawings in disassembled form. As shown in FIG. 10, the device can be conveniently and easily packaged and assembly of the device into its operative condition or disassembly of the device will be easily achievable. The packaging 106 is preferably made from a transparent material so that the device can be identified therethrough and the user can be sure that all components are safely packaged when the device is to be stowed away. The package 106 includes a handle section 108.

Clearly the invention is not limited to the form of the device as depicted herein. It is, however, important that the leg engaging members 26 are easily and smoothly slidable on the strut 12. The advantages of having the strut 12 formed in at least two separable sections will be clearly evident from the aforegoing description. The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. An exercise device comprising:

an elongate strut having a plurality of sections which are separable from each other, the sections each have first and second ends with the first end of each respective section being connectable to the second end of another section to form a separable connection having at least one disengaging button, said first and second ends are male and female plug and socket type connections for releasably locking the first and second ends together;

a pair of limb engaging members located on the strut at least one of which is movable along the length of the strut towards and away from the other member; and resistive force means linking the movable limb engageable member to a reaction point on either the strut or the other limb engaging member: the arrangement being such that movement of the movable limb engaging member along the strut in at least one direction requires work to be done against the action of the resistive force means.

2. An exercise device according to claim 1, wherein both of the limb engaging members are movable along the length of the struts towards and away from each other.

3. An exercise device according to claim 2, wherein there are a pair of reaction points on said strut.

4. An exercise device according to claim 1, wherein the resistive force means comprises at least one elastomeric band.

5. An exercise device according to claim 4, wherein the resistive force means comprises a plurality of elastomeric bands which can be utilised in selected numbers to vary the resistive force provided by the bands.

6. An exercise device according to claim 1, wherein the device is assembleable so that one of the limb engaging members projects to one side of the strut and the other limb engaging member projects to the opposite side of the strut.

7. An exercise device according to claim 1, wherein each limb engaging member comprises at least one curved arm which is adapted to locate around at least part of the thigh of a user.

8. An exercising device according to claim 7, wherein each limb engaging member comprises a pair of curved arms which are spaced apart to define an inverted U-shaped space therebetween which space is adapted to receive the thigh of a user therein.

* * * * *